United States Patent [19]

Rosenfeld et al.

[11] Patent Number: 4,994,314

[45] Date of Patent: Feb. 19, 1991

[54] COLOR CHANGE DEVICES INCORPORATING THIN ANODIC FILMS

[75] Inventors: Aron M. Rosenfeld; Paul Smits, both of Kingston, Canada

[73] Assignee: Alcan International Limited, Montreal, Canada

[21] Appl. No.: 306,766

[22] Filed: Feb. 3, 1989

[51] Int. Cl.[5] ..... C25D 11/04; B65D 85/00

[52] U.S. Cl. ..... 428/36.92; 204/15; 204/42; 428/469; 428/472.2; 428/915

[58] Field of Search ..... 428/915, 472.2, 469, 428/35.8, 36.92; 204/15, 42

[56] References Cited

U.S. PATENT DOCUMENTS

| | | | |
|---|---|---|---|
| 29,739 | 3/1962 | Kessler | 204/56 R |
| 3,971,710 | 5/1976 | Romankiw | 204/15 |
| 4,321,217 | 3/1982 | Phillips et al. . | |
| 4,424,911 | 7/1984 | Resnick . | |
| 4,448,317 | 1/1984 | Thompson . | |
| 4,480,760 | 11/1984 | Schonberger . | |
| 4,489,841 | 12/1984 | Thompson | 215/203 |
| 4,502,605 | 1/1985 | Wloszczyna . | |
| 4,511,052 | 1/1985 | Howard . | |
| 4,516,679 | 2/1985 | Simpson et al. . | |
| 4,519,515 | 2/1985 | Schonberger . | |
| 4,557,505 | 12/1985 | Schaefer et al. . | |
| 4,591,062 | 2/1985 | Sandhaus . | |
| 4,705,300 | 5/1986 | Berning et al. . | |
| 4,705,356 | 5/1986 | Berning et al. . | |
| 4,837,061 | 6/1989 | Smits et al. | 428/915 |
| 4,868,004 | 9/1989 | Zültzke et al. | 427/42 |

FOREIGN PATENT DOCUMENTS

| | | |
|---|---|---|
| 0227423 | 2/1981 | European Pat. Off. . |
| 3724614 | 1/1988 | Fed. Rep. of Germany . |
| 3742204 | 6/1989 | Fed. Rep. of Germany . |
| 2168383 | 6/1986 | United Kingdom . |
| 2193974 | 2/1988 | United Kingdom . |

OTHER PUBLICATIONS

W. L. Baun, J. of Materials Science 15 (1980) 2749–2753 "Anodization of Evaporated Aluminium on Ti-6 wt % Al-4 wt % V".

A. E. Yaniv and I. E. Klein, Corrosion Science 1971, vol. 11, pp. 343–352—"Anodizing in Fluoroboric Acid Solution".

L. Young, 1957, Transactions Faraday Society, 58, 841.

W. E. Hillig, cited in D. A. Vermilyea, 1957, J. Electrochemical Society 104m 485.

B. Maurel, D. Dieumegard and G. Amsel, 1972, J. Electrochemical Society 119, 1715.

A. Aladjem and D. G. Brandon, 1969, J. Vacuum Science and Technology 6, 635.

R. E. Pawel and T. S. Lundy, 1964, J. Applied Physics 35, 435.

(List continued on next page.)

*Primary Examiner*—James Seidleck

*Attorney, Agent, or Firm*—Cooper & Dunham

[57] ABSTRACT

A laminated color change device which exhibits an irreversible color change upon delamination. The device comprises two layers capable of generating a color by a light interference and absorption phenomenon that requires direct and intimate contact between the two layers. One of the layers is a color-generating metal, such as a valve metal (e.g. tantalum), and the other is an overlying light-transmitting film thin enough to cause light interference effects. The film is produced by coating the color generating metal with aluminum or an aluminum alloy and then anodizing (preferably porous anodizing) the aluminum to consumption in the presence of an adhesion-reducing agent, e.g. fluoride, that reduces the strength of attachment between the layers so that the laminate can be uniformly and reliably separated at the interface between the adjacent two layers. An overlying layer of transparent or translucent material is normally adhered to the laminate to facilitate the separation of the layers. When the thin film is detached from the color-generating metal, the generated color is lost, thus providing a color change that is in effect irreversible. The device can be incorporated into a variety of closable articles or products to provide evidence of opening or tampering, or can be used for other purposes.

37 Claims, 7 Drawing Sheets

OTHER PUBLICATIONS

R. E. Pawel, J. P. Pemsler and C. A. Evans, 1972, J. Electrochemical Society 119, 25.

The Optical Properties of Thin Oxide Films on Tantalum–Charlesby et al.–Proc. Royal Society A 227 (1955) 434,443.

Anodizing the Reactive Metals–Seeley–Metal Finishing Aug. 1986.

Metallurgy of the Rarer Metals–6 Tantalum, Niobium, G. L. Miller–Butterworth Scientific Publications London 1959.

The Coloration of Refractory Metals–James B. Ward–American Metal Smith.

COLOR CHANGE DEVICES INCORPORATING THIN ANODIC FILMS

BACKGROUND OF THE INVENTION

I. Field of the Invention

This invention relates to color change devices incorporating thin anodic films capable of generating colors by light interference effects, to methods of making such devices, and to closures and other articles incorporating such devices.

By the term "color change device" we mean a laminated structure which exhibits a first color over a suitably large surface area but which is capable of exhibiting a noticeably different second color over the whole or a part of the surface area when the structure is physically disturbed in some way, e.g. when the constituent layers are peeled apart or when the device is punctured or cut.

II. Description of the Prior Art

There is currently a growing need for color change devices incorporating structures which undergo some kind of irreversible and readily-observable change when the constituent structures are peeled apart or otherwise disturbed. Such devices may be incorporated, for example, into the closures of containers or packages in such a way that an irreversible visible change is observable when the containers or packages are opened. Alternatively, when identity documents or cards are laminated for security, devices of the above type may be incorporated into their structures to warn of tampering. Furthermore, there is a growing market for "instant win" type lottery tickets which contain a message concealed beneath a peelable or scratchable obscuring layer and it would be advantageous to incorporate color change devices into such tickets to discourage unauthorized viewing of the message prior to sale.

Various types of structures which undergo irreversible visual changes are already known. For example, U.S. Pat. No. 4,557,505 issued on Dec. 10, 1985 to Richard M. Schaefer, et al discloses a transparent tape which becomes opaque when subjected to stress, e.g. when peeling or tearing of the tape is attempted, and similar "stress whitening" properties of plastics materials are utilized in the devices of U.S. Pat. No 4,489,841 issued on Dec. 25, 1984 to Mortimer S. Thompson and U.S. Pat. No. 4,448,317 issued on May 15, 1984 to Mortimer S. Thompson. Another approach to the problem has been the use of micro-encapsulated dyes which change color upon exposure to air when the capsules are ruptured (e.g. U.S. Pat. No. 4,519,515 issued on May 28, 1985 to Milton Schonberger; U.S. Pat. No. 4,480,760 issued on Nov. 6, 1984 to Milton Schonberger; and U.S. Pat. No. 4,424,911 issued on Jan. 10, 1984 to Joseph A. Resnick). Additionally, much attention has recently been directed to the use of holograms having a three dimensional visual effect, and iridescent optical multilayer films, made by vacuum deposition, which exhibit a distinctive color change with viewing angle, such effects being easily destroyed when the structures are damaged.

The disadvantages of the known devices are that they are either expensive to produce (e.g. the holograms and optical multilayer films), release contaminating chemicals (e.g. microencapsulated dyes) or can be defeated or replaced if sufficient care is taken (e.g. the stress-whitening plastics).

We have previously found that color change devices can be made from a peelable laminate that relies on direct and intimate contact between at least two layers to generate an intense non-dichroic interference color. When the layers are peeled apart, the generated color disappears (or changes to a different color depending on the structure of the device) and is difficult or impossible to regenerate because the required direct and intimate contact cannot be restored by normal means (e.g. pressing or gluing the layers back together again). In a preferred form, the device of this kind comprises a thin layer of a so-called "valve" metal (e.g. Ta, Nb, Ti, Zr and Hf) having a very thin non-porous overlying anodic layer of the valve metal oxide. Such a structure generates an intense color by a light interference and absorption effect (i.e. interference takes place between light reflected at the metal and oxide surfaces and some light absorption takes place at the metal-oxide interface). Normally, anodized oxide layers adhere strongly to the underlying metal, but we have found that the presence of certain adhesion-reducing agents (e.g. fluoride ions) during anodization reduce this adhesion in a uniform and reliable way and hence make the structure peelable at the metal-oxide interface. This invention is the subject of our prior U.S. Pat. No. 4,837,061 issued on June 6, 1989 (the disclosure of which is incorporated herein by reference).

Tamper-evident structures of the above kind undergo a substantially irreversible color change when the two adjacent layers are separated from each other because the direct and intimate contact required for color generation is difficult or impossible to restore once the adjacent layers have been peeled apart, and the substantially irreversible color change acts as evidence that the layers have been separated and consequently that the structure has been disturbed. Since the color change is based on a light interference and absorption phenomenon, which is a physical rather than a chemical phenomenon, the operability of the structure is substantially unaffected by heat, humidity, aging etc.

While tamper-evident devices of the above kind are extremely effective and useful, they suffer from the disadvantage that the materials capable of generating the desired intense colors are inconvenient to anodize as they require high voltages (i.e. anodizing to high voltage at constant current). Our prior devices also require the use of quite large amounts of expensive materials, such as tantalum. Moreover, only very thin oxide layers can be produced and this limits the colors that can be generated, generally precluding dichroic films which would be realized by thicker layers. A dichroic film is one which exhibits a particular color when viewed from one angle, say at normal incidence, but a different color when viewed from another angle. In general, for such films the color changes continuously through several hues as the viewing angle is varied and the films have accordingly also been called optically variable films. Dichroism is a desirable feature for some applications due to consumer appeal. Also, since the dichroic feature can not be reproduced by color photocopiers, it confers an additional element of security to a color change device used in tamper evident structures. In some cases though, dichroism is to be avoided since it may confuse the consumer as to which color change is to be taken as evidence of tampering, and so it would be desirable to have the option of making the color change device either dichroic or non-dichroic.

OBJECT OF THE INVENTION

It is therefore an object of the present invention to facilitate the production of color change devices of the above kind, thus making them less expensive and hence more widely applicable, and to extend the optical variability of the structures which can be obtained.

SUMMARY OF THE INVENTION

The present invention is based on the use of aluminum or an anodizable aluminum alloy as the material to be anodized rather than the color-generating metal. This has the advantage that the anodization step is easier (lower voltages are required), the anodic film can be grown to any desired thickness (when porous anodization is carried out) and the use of expensive metals can be limited.

According to one aspect of the invention, there is provided a process for producing a color change device, which comprises: forming a color-generating laminate by providing a layer of a metal capable of generating a color by a light interference and absorption phenomenon when directly and intimately contacted with an optically thin film of light-transmitting material; coating said layer of metal capable of generating a color with a material selected from the group consisting of aluminum and anodizable aluminum alloys to such a thickness that the resulting coating is converted to an optically thin film upon being porous anodized to consumption; and anodizing said coating to consumption in the presence of an adhesion-reducing agent to form an optically thin detachable film of light-transmitting material in direct and intimate contact with said metal capable of generating a color.

According to another aspect there is provided a color change device, which comprises: a layer of a metal capable of generating a color by a light interference and absorption phenomenon when directly and intimately contacted with an optically thin film of light-transmitting material; and an optically thin film of light-transmitting material comprising anodic aluminum oxide directly and intimately contacting said metal capable of generating a color; said optically thin film being detachable from said layer of metal capable of generating a color in areas of said device where a color change is desired.

In a further aspect, the invention relates to a container incorporating a color change device of the above type.

By the term "optically thin" used throughout this specification to describe the transparent anodic film we mean that the film is so thin that significant interference takes place between light reflected from an upper surface of the film and an upper surface of the color generating metal layer forming a substrate for the film.

In the following description, reference is made to the use of aluminum itself for the sake of convenience, but it should be kept in mind that anodizable aluminum alloys could be used instead.

BRIEF DESCRIPTION OF THE DRAWINGS

FIGS. 12 (*a*)–(*e*) and 13 (*a*) and (*b*) are photomicrographs illustrating structures produced in the Examples.

Figure 1A:
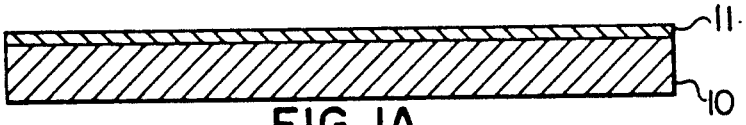
FIG. 1 (*a*)–(*d*) is a diagram showing intermediates and products formed according to a preferred embodiment of the process of the invention.
Figure 1B:
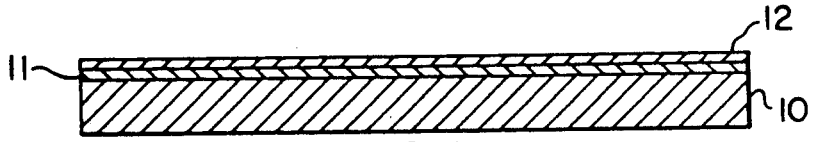
Figure 1C:
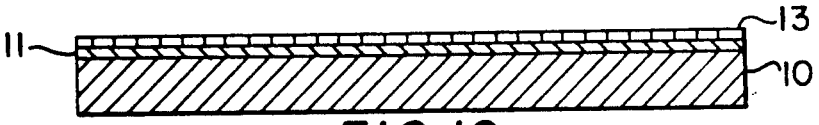
Figure 1D:
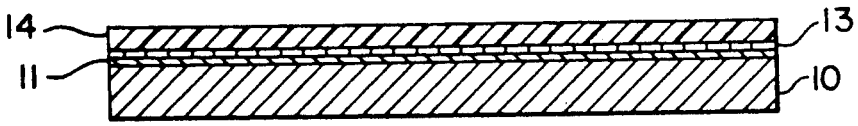

It should be noted that the relative thicknesses of various layers shown in the drawings are not to scale, except in the case of FIGS. 12 and 13.

DETAILED DESCRIPTION OF THE INVENTION

We have found that the optically thin anodic films used in our former invention can be replaced by anodic aluminum oxide films while retaining the necessary color generating effect on the color generating metals. When the oxide film is produced by porous anodization, the film can be grown to any desired thickness, and so a range of desirable color, which may be either dichroic or non-dichroic can be accessed. Moreover, we have also found that the adhesion-reducing agents used in our former invention, when present during the anodizing of the aluminum to form the anodic layer, exert an adhesion reducing effect at the interface between the anodic film and the underlying metal. This is surprising because (a) no color is generated when an optically thin anodic film is formed on the surface of aluminum itself and (b) anodic films formed on aluminum are not easily detachable, Even when an adhesion reducing agent from our former invention is present during the anodizing step.

The anodic film of aluminum oxide may be formed by either non-porous ,or porous anodizing a layer of aluminum deposited onto the color generating metal. In order to produce the color generating effect, the aluminum layer must be anodized to consumption and a barrier layer of an oxide of the underlying color generating metal formed at the color generating metal surface. When non-porous anodization is chosen, the aluminum layer must be very thin in order to ensure that the aluminum is consumed before the barrier oxide film reaches its maximum possible thickness. On the other hand, a layer of aluminum of any thickness can be anodized to consumption when the electrolyte contains an acid suitable for the production of a porous oxide layer. For this reason, porous anodization is preferred and is the main subject of the following detailed description.

As in the case of our former invention, the essentially irreversible color generation phenomenon made use of in the present invention relies on direct and intimate contact between the anodic film and the color generating metal. By "intimate contact" we mean that the two layers conform closely with each other at the microscopic level at the interface or indeed structurally merge together in the region of the interface. By "direct contact" we mean that there is essentially no other material between the two layers at the interface and this excludes the presence of glues, adhesives and the like. As noted above, direct and intimate contact is difficult to re-establish once the layers have been separated because mere pressing of the layers together again cannot exclude intervening gas molecules and re-establish suitably close contact (particularly if the surfaces of the layers are moderately rough). Moreover, the use of an adhesive to bond the separated layers together does not result in re-establishment of the color since it prevents the required direct contact and introduces an optically thick layer that precludes the color generation phenomenon.

As in our former invention, the color generation relies on a combination of an interference effect and a light absorption effect, the latter taking place at the interface between the light-transmitting anodic film and the layer of color generating metal. When the light-transmitting film is very thin (e.g. 20 to 170 nm), the resulting colors are intense and non-dichroic. When the light-transmitting film is slightly thicker (e.g. 170 to 1000 nm), intense dichroic colors are visible. When the light-transmitting film is even thicker (e.g. more than 1000 nm), the colors tend to fade and eventually the laminate resumes the normal color of the underlying metal. Although dichroic colors can be generated by thin films formed on various substrates merely by interference without the specific additional absorption effect of the present invention, this requires structures having three or more distinct layers, e.g. as in the case of multilayer dielectric stacks, and these structures suffer from the fact that the original color, or some other color, can usually be regenerated by relamination of the separated layers.

A particular advantage of the preferred form of the present invention is that a range of dichroic colors can be produced as well as a range of non-dichroic colors. This is because the porous anodic film can be grown to the necessary thickness and because aluminum oxide has a suitable refractive index. In general, for a given thickness of dielectric material in a layered color generating interference structure, dichroism is enhanced by choosing materials of lower index of refraction. As well, for a given index of refraction, dichroism is enhanced for films of greater thickness. If the thickness is too great though, the constructive interference condition can be satisfied at a single dielectric thickness for several different wavelengths (these satisfying the condition in different orders) so that the film color tends to fade as more components of the incident white light are reflected constructively. This situation is reached at greater thickness for lower index dielectrics. The ability to form thicker light-transmitting films by means of the porous anodization embodiment of the present invention than was the case with our former invention, and the ability to form films which generally have lower indices of refraction (e.g. 1.6 for $Al_2O_3$ versus 2.2 for $Ta_2O_5$, means that dichroic structure can easily be formed, when desired.

The color-generating metals which can be used in the present invention are essentially the same as those employed in our previous invention, e.g. the valve metals (Ta, Nb, Zr, Hf, Ti etc.) and alloys of these metals. These are metals characterized in general by reflectivities over the visible spectrum of 40–60%, preferably 45–55%, and more preferably approximately 50%. The preferred metals in this group are Ta and Nb.

The color-generating metal itself may be in the form of a self-supporting foil or plate, but is more preferably used in the form of a thin layer deposited onto a suitable substrate, such as an aluminum plate or foil or a polymeric substrate such as polyester. If the substrate is electrically conducting, such as Al, then an extremely thin layer of the color-generating metal can be used since it need not support the current during anodizing. The use of a thin layer not only reduces costs (since the color generating metals tend to be very expensive), but also improves the security of the resulting device as will be explained later.

An aluminum coating is formed on the color generating metal. The aluminum coating should desirably be intimately bonded to the underlying metal so that there is no possibility for impurities or microstructural inhomogeneities to be present at the interface between the two metals which might interfere with the adhesion-reduction effected during the anodization step. Any technique capable of forming a thin strongly adhering coating of aluminum on the color-generating metal may be employed, but vacuum deposition methods such as sputtering and evaporation are preferred techniques because of the excellent adhesion and thickness and uniformity control achievable by these techniques.

The aluminum coating formed on the color-generating metal is normally quite thin (e.g. in the range of 20–1000 nm in most cases) because it is converted, when anodized to consumption, to the optically thin light-transmitting film required for color generation. The following factors should be taken into account when the desired thickness of the aluminum layer is determined. The anodization step produces an aluminum oxide film thickness which is approximately 40% greater than the thickness of the aluminum coating itself, although the actual thickness depends on the anodizing conditions and can be precisely controlled. As well, the anodization usually proceeds to some extent into the underlying color-generating metal following complete anodization of the aluminum, and so the light-transmitting film is usually a little thicker than that resulting from the anodization of the aluminum layer itself.

The thickness of the aluminum metal which has to be coated on the color-generating metal in order to obtain a predetermined generated color following anodization is simply calculated. For example, when tantalum is the color-generating material, a color produced by a certain thickness of tantalum oxide on tantalum as in our former invention can be duplicated for a thickness of aluminum oxide on tantalum satisfying the equation:

$$n_1 d_1 = n_2 d_2$$

wherein $n_1$ is the refractive index of tantalum oxide, $n_2$ is the refractive index of aluminum oxide, $d_1$ is the thickness of the tantalum oxide film and $d_2$ is the thickness of the aluminum oxide film (i.e. when the optical thicknesses of the layers are the same, the same color is generated). As noted above, some allowance does have to be made for the fact that the anodization proceeds for a very short distance into the tantalum layer.

As the next step in the process, the aluminum coating is anodized, preferably in an electrolyte suitable for normal porous anodization of aluminum, e.g. a solution containing a strong acid such as phosphoric acid or sulfuric acid. This type of anodization process is well known to persons skilled in the art and so elaboration is believed to be unnecessary. The aluminum layer is anodized to consumption and, when porous anodization is carried out, forms an oxide layer having pores extending inwardly from the outer surface. However, the porous part of the anodic film is separated from the underlying metal by a non-porous barrier layer which may include, or consist of, the oxide of the color generating metal formed by the consumption of a thin upper layer of this metal.

The anodization is carried out in the presence of an adhesion-reducing agent which may be coated on the aluminum surface prior to the start of the anodization treatment or may be added to the anodization bath. Moreover, it is possible to introduce the adhesion-reducing agent at various stages during the anodization procedure, e.g. by commencing the anodization in a bath not containing the adhesion-reducing agent and then transferring the structure to a second bath containing the adhesion-reducing agent for further anodization.

The preferred adhesion-reducing agent is fluoride, which may be used in the form of a solution of simple salts, e.g. NaF or KF, or in the form of complex salts, or fluorinecontaining compounds or in acids such as hydrofluoric acid, fluoroboric acid, etc. The required amount of fluoride depends on the particular valve metal, the choice of anodizing electrolyte and the anodizing voltage, and can be found by simple trial and experimentation in any particular case. For example, this amount can be made as low as about 0.005% by volume (although it is more usually at least 0.05% by volume) of the anodizing electrolyte when tantalum is used as the color-generating metal.

It is mentioned above that the adhesion-reducing agent may be coated on the surface of the aluminum prior to the anodization step. If the adhesion-reducing agent is coated on only limited areas of the metal surface, the thin oxide film subsequently formed is readily detachable only from the areas to which the agent was applied, and this makes it possible to form latent patterns or messages in the laminated structure which become visible only when the thin film has been removed from the treated areas. The patterns or messages become visible following the detachment step because the film in the untreated areas cannot be detached and retains its generated color whereas the areas where the film is detached lose their color irreversibly. The same effect can be produced during anodization by the following alternative technique. That is, limited areas of the color-generating metal surface may be masked off, e.g. with an adhesive tape, silk screening of a suitable anodizing resist, and the like, and the remaining areas subjected to a preliminary anodization treatment employing an anodization bath containing the adhesion-reducing agent. The masked areas may then be unmasked and the entire surface subjected to anodization in a bath containing no adhesion-reducing agent. As a result, the originally masked areas are non-detachable and the unmasked areas are detachable. Latent messages, logos, intricate patterns etc. can be produced in this way. Since the aluminum is anodized to consumption in all areas of the coating, an even color is produced following the anodization step so that the message is truly latent, i.e. undetectable prior to removal of the film.

If the layer of color-generating metal is made so thin as to be translucent, it may be possible to incorporate a hidden message into the structure by a different technique from the one mentioned above. That is, a message may be printed on a substrate surface covered by the color generating laminate. When the laminate is intact, the message will be obscured by the generated color (particularly if the message is printed in ink of the same hue as the generated color). After detachment of the film, the generated color will be lost and the printed message will be visible through the overlying translucent layer of color-generating metal. An example of such a message would be "warning, this container has been opened".

Instead of a message, the entire surface of a substrate may be made to have a color different from the generated color, thus providing a mechanism for producing a change from one color to another when detachment of the film takes place.

The above represents one of the ways in which the security of the device can be improved by making the color-generating metal extremely thin. Another way is to make the metal so thin that following detachment of the anodic film, the exposed metal cannot itself be anodized to a sufficient extent to grow an anodic film of its own oxide of suitable thickness to generate a color identical or similar to the original color of the device.

Additional color capabilities can be optionally imparted to the devices of the invention employing porous oxide films by a further process step. In the case of anodic films obtained by directly porous anodizing aluminum or aluminum alloys without an underlayer such as Ta, the anodic films is normally transparent and colorless. Such anodic films can however be colored by the well-known process of electrolytic deposition of a metal or metal compound (inorganic pigment) into the pores of the film. This involves passage of current from the electrolyte through the thin barrier aluminum oxide layer beneath the porous structure to the underlying aluminum metal. The colors that can thereby be obtained are rather limited, ranging from brown through bronze shades to black as the pores are increasingly filled with pigmentary deposit. The coloring effect is due to wave-length selective scattering and absorption by the deposit within the anodic film of light reflected from the surface of the underlying aluminum metal. This effect can be combined with the interference and absorption effect created in the preferred device of the present invention by electrodepositing the pores of the anodic film with a metal deposit by a standard electrodeposition technique. Surprisingly, it has been found that the adhesion reducing effect necessary for the detachability of the anodic film is not altered by the electrodeposition process and further that the adhesion-reduced anodic film is capable of surviving the rather aggressive electrodeposition process without spalling off.

If the electrodeposits are made very thin (i.e. if they occupy just the bottom portion of the pores), it is found that the combination of the interference and absorption effect with the additional scattering effect due to the deposits produces coloration effects not achievable with the original structure. These include much stronger colors for thicker anodic films as well as significantly enhanced dichroism for anodic films with the deposits compared to similar films of the same thickness without deposit. While the precise mechanism for a given color effect is difficult to predict theoretically for such films that combine interference, absorption, and scattering in a complex manner, the controllability of both the anodizing and electrodeposition processes allows accurate reproducibility of these effects.

In preferred forms of the device of the invention it is advantageous to attach a layer of transparent or translucent material to the porous aluminum oxide surface in order to facilitate detachment of the anodic film from the underlying metal. This material should of course transmit sufficient light to allow the color to be generated and to allow the generated color to be seen, and is preferably thin and flexible to permit the anodic film to be peeled away from the substrate. The transparent or translucent material may be attached directly to the anodic film e.g. by heat sealing it to the film, or it may be indirectly attached to the film by means of an adhesive. An example of a suitable heat-sealable material is a clear sheet of polyester (e.g. the material sold by DuPont under the trade mark MYLAR) or polypropylene. By leaving part of the sheet unsecured to the film at an edge, a graspable tap is formed, which can be used to assist with peeling of the film. Naturally, for detachment to be successful, the layer must adhere more strongly to the film than the film adheres to the color-generating metal in those areas where a color change is desired. The layer of material also serves to protect the thin anodic film from damage or unintentional separation.

For certain applications, peelable structures are not required at all. For example, if the device is intended to warn of puncturing or cutting, then the implement penetrating the laminate inevitably causes localized detachment of the anodized film from the color-generating metal. For these applications, the overlying layer need not be as flexible.

The overlying layer does not normally contribute to the color generating properties of the device and is usually colorless, but it could be colored, if desired, making visible an altered color different from that generated by the laminate itself.

In some cases where the film is to be detached by peeling, it may be desirable, in order to produce a peel strength predetermined for a particular application, to "tune" the adhesion between the layer of color generating metal and the thin film to a finer degree than is possible merely by adjusting the concentration of the adhesion-reducing agent. For example, if the adhesion between the layer and the thin film is too weak to survive forming processes or handling, the laminate may be subject to accidental peeling which would reduce the reliability of the resulting device. In these cases, peelable areas may be mixed with non-peelable areas in various patterns (e.g. as stripes or dots) using the masking techniques mentioned above, in which case the overall peel strength of the laminate is increased by the adhesion between the overlying layer and the thin film in the non-peelable areas (since the layer has to be pulled away from the thin film in the non-peelable areas). Thus the overall adhesion can be modified either by suitably adjusting the adhesive strength between the overlying layer and the thin film or by suitably varying the peelable to non-peelable area ratio.

The color generating devices of the present invention can be employed, among other things, for a variety of security applications. For example, the devices may be incorporated into closures of containers, packages, envelopes, etc. in such a way that the devices are inevitably peeled apart, punctured, torn or cut when the containers etc. are opened or access to the contents is attempted. The visible color change, or optional latent message, provides clear evidence that the container etc. has been opened or tampered with. The devices can also be incorporated into items, such as identity documents, not intended to be opened in order to warn of tampering. Furthermore, by making use of the ability of the devices to contain latent messages, the structures may be used for "instant-win" tickets or the like, because information can be obscured (and in fact made completely invisible) until the anodic film is detached from certain areas. After such detachment, the structure cannot be restored to its original condition and so the information cannot be viewed prior to sale of the ticket without leaving clear evidence of mis-use.

Preferred embodiments of the invention are described in more detail below with reference to the accompanying drawings.

FIG. 1 illustrates the steps in the formation of a structure according to a preferred embodiment of the present invention. In (a) a metal foil 10 (e.g. of aluminum) is coated with a thin layer 11 of a color-generating metal (e.g. tantalum) by a suitable coating process (e.g. vacuum sputtering). In step (b), the resulting structure is then provided with a thin coating 12 of aluminum, again preferably by vacuum sputtering. In step (c), the structure is porous anodized in the presence of fluoride ions and the aluminum coating 12 is converted to a porous anodic oxide film 13. In step (d), the resulting laminate is covered with an adhering overlying layer 14 of flexible transparent or translucent material. The thickness of the aluminum coating 12 is made suitable for color generation when converted to an anodized film in step (c).

Figure 2:
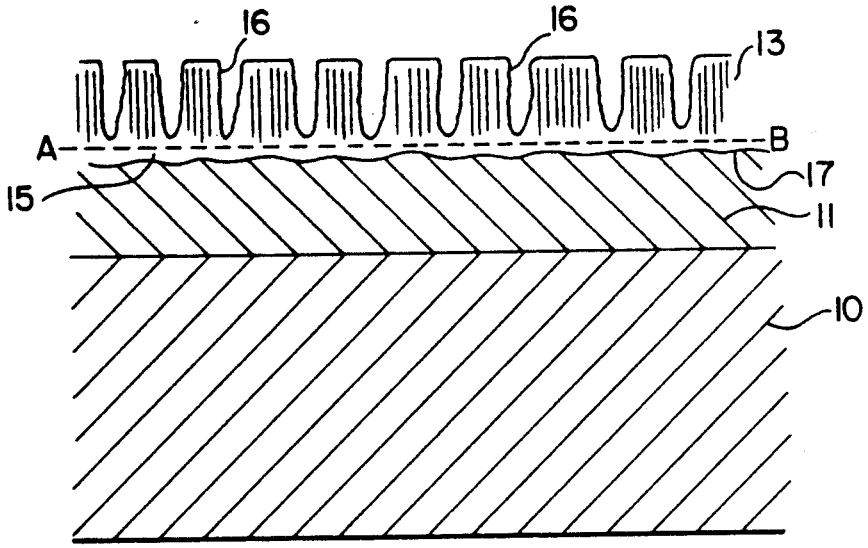
FIG. 2 is an enlarged cross-sectional view of the embodiment of FIG. 1(C)

FIG. 2 is an enlarged cross-sectional view showing layer 11 and film 13 following step (c). The anodized film 13 extends slightly below the interface (shown by the dotted line A-B) between former layer 11 and coating 12 in step (b) and a barrier layer 15 between pores 16 and the color generating metal 11 is composed of tantalum oxide (when material 11 is tantalum) or mixed tantalum and aluminum oxides. The anodization does not proceed far into the color-generating metal layer because the anodization of this layer stops shortly after it commences at the voltages employed for the anodization of aluminum. This is because the thickness of anodic films generated on valve metals such as Ta is limited by the anodizing voltage rather than the time of anodizing as for porous anodizing of Al.

Destruction of the generated color occurs upon detachment of the layers at the interface 17 between the color-generating metal 11 and the anodized film 13 and this detachment is made possible by virtue of the fact that the anodization was carried out in the presence of fluoride ions.

Figure 3:
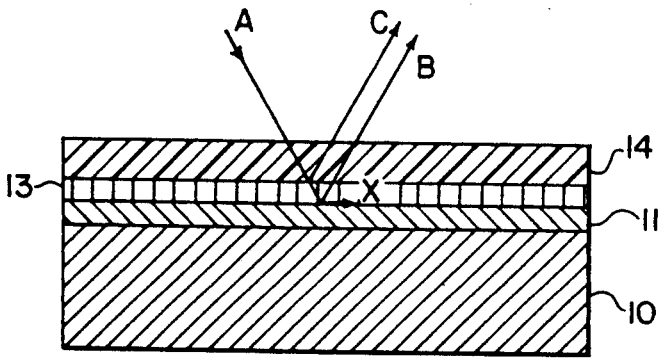
FIG. 3 is a cross-section of a color generating structure showing the manner in which the color is generated.

FIG. 3 shows the manner in which the color is generated in the structure following step (d) of FIG. 1. White light incident on the structure, indicated by ray A, is partially reflected by the upper surface of the thin film 13 (ray C) and is partially transmitted to be reflected (ray B) by the upper surface of the metal layer 11. The interference colors generated when rays B and C combine will be weak if the relative intensities of rays B and C differ significantly, but will be strong if the intensities are similar. If highly reflective metals (such as aluminum) were used for the layer 11, most of the light would be reflected at the upper surface of the metal layer and so ray B would be much more intense than ray C. In the case of the color-generating metals suitable for the present invention, however, light absorption (indicated by arrow X) takes place at the interface between thin film 13 and the layer 11. This absorption reduces the intensity of ray B and makes the intensities of rays B and C more comparable so that an intense color is generated. The light absorption depends on direct and intimate contact between layer 11 and film 13 and separation of these layers causes the intense color to be lost, leaving the grey color of the metal 11. Once the layers have been separated, the intense color cannot be regenerated by repositioning film 13 on layer 11, even if the layers are pressed together, because the contact will no longer be direct (gas molecules intervene) and/or intimate (the surfaces will no longer conform closely at the microscopic level). For the structure to be useful in the invention, the laminate must be reliably detachable at the interface between thin film 13 and layer 11, which is assured by the use of the adhesion reducing agent during the anodization step.

Figure 4:
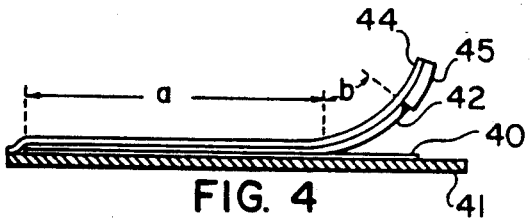
FIG. 4 is a cross-section of a structure as it is peeled apart.

FIG. 4 is a cross-section of an embodiment of a tamper-evident structure similar to the product of step (d) shown in FIG. 1. It consists of a flat substrate 41, preferably made of aluminum foil, a layer 40 of a valve metal, preferably tantalum, produced by vacuum sputtering, a thin film 42 of porous anodized aluminum (and some anodized tantalum) and an overlying strip 44, preferably made of a transparent plastic. One end of the strip has an underlying anti-adhesion strip 45 to form a non-adhering tab which may be easily gripped between finger and thumb to facilitate the peeling procedure.

When the strip 44 is pulled away from the substrate 41 in the manner shown at the right hand side of FIG. 4, the adhesion between the strip 44 and the underlying thin film 42 causes the latter to be peeled away from the color-generating metal layer 40 because the adhesion between these two layers is less than the adhesion between the thin film and the adhering strip. In the region "b" where the layers are separated, the thin film 42 and the color-generating metal layer 40 take on their normal, colors, i.e. the thin film 42 is colorless and the layer 40 has a metallic gray color. In the region "a" where the layers 40, 42 are in direct and intimate contact, an intense generated color is visible through the strip 44. As the region "b" increases in area and the region "a" reduces in area, the area of visible color shrinks and is eliminated when the layers 40 and 42 are completely separated.

Once the layer 40 and thin film 42 have been separated, attempts to re-laminate them fail to re-generate the original color and the layers retain their natural appearances. No amount of pressing or adhering of the layers results in regeneration of the original color. Consequently, the irreversible loss of the original color provides reliable evidence of separation of the layer 40 and thin film 42 and this feature can be used to indicate tampering with or prior use of the tamper-evident structure.

Figure 5:
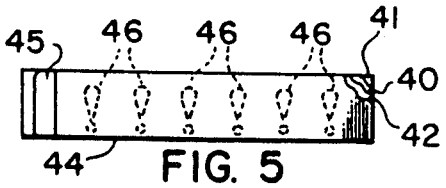
FIG. 5 is a top plan view of an embodiment containing a latent message.

FIG. 5 shows a device similar to that of FIG. 4 except that the device incorporates a latent message indicated by exclamation points 46. These are formed by regions of the thin film 42 which are not easily detachable from the metal layer 40 by virtue of their formation in the absence of the adhesion-reducing agent. When the strip 44 is peeled away, the film 42 detaches in all areas except regions 46, hence the generated color is lost, except in the regions 46 which consequently are visible against a colorless or grey background.

Figure 6:
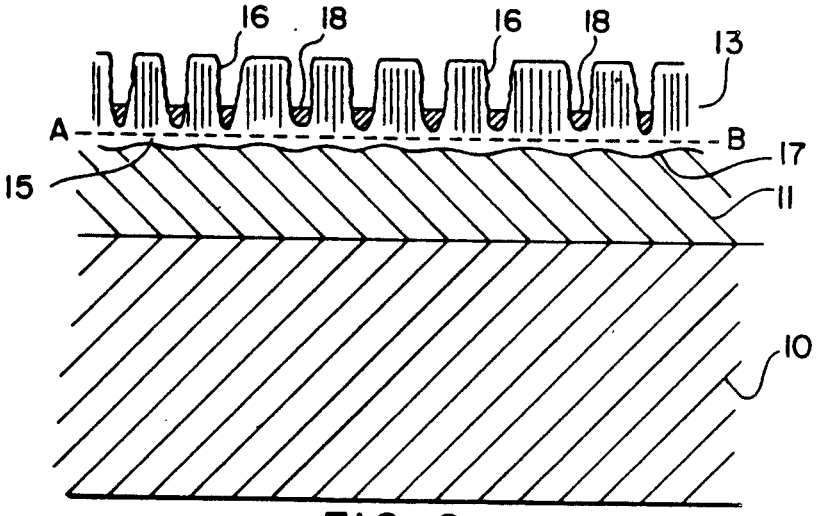
FIG. 6 is a view similar to FIG. 2, showing metal deposits in the pores.

FIG. 6 is a view similar to FIG. 2 showing metal deposits 18 in the pores 16, these metal deposits having been formed by electrodeposition from a solution containing a salt of the metal. The deposits 18 serve to absorb and/ or scatter certain wavelengths of incident light and hence modify the generated color in order to make it either more intense or more dichroic.

Figure 7:
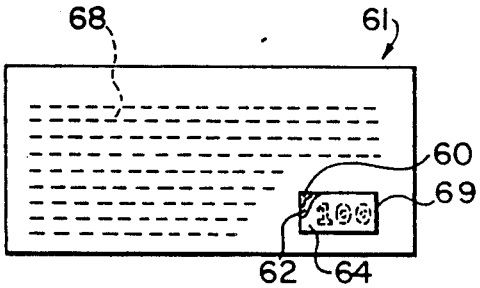
FIGS. 7 to 11 illustrate various products incorporating color change devices according to preferred forms of the present invention.

FIG. 7 shows a particular use for a tamper-evident structure of the present invention. An "instant win" or similar ticket 61 is provided with normal printing 68 and with a box 69 comprising a laminated structure having a color-generating metal layer 60, a thin porous anodic film 62 and an overlying plastic strip 64. In this embodiment, the substrate, equivalent to the layer 41 of FIG. 4, may be the ticket 61 or an intervening foil layer.

The box 69 contains a latent message, e.g. the number "100" as shown, formed by making the areas of the message non-peelable and the remaining areas peelable, in the manner indicated previously.

Prior to sale of the ticket, the box 69 has a visible color resulting from the intimate contact of the layer 60 and the thin film 62, and the latent message is invisible because the area of the latent message is the same color as the remaining area of the box 69. Upon purchase, the purchasor peels off the plastic strip 64 or scratches it away, e.g. with a coin, a knife or an eraser. The thin film 62 easily peels away from or flakes off the metal layer 60 in the non-message areas, but remains in place in the message areas. In consequence, the message becomes visible as colored areas against a metallic-colored background. Once the message has been viewed, the box cannot be returned to its original condition because, even if the removed parts of the thin film are replaced, the original color cannot be regenerated in the separated areas.

It would of course be possible to make the areas of the message peelable and the remaining areas non-peelable, rather than vice versa as described above. The message would then appear as colorless shapes against a colored background.

Figure 8:
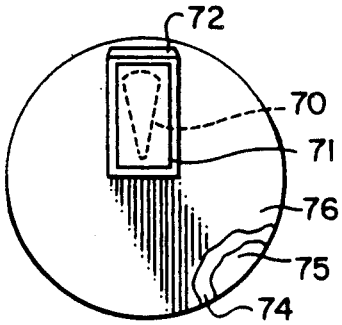

FIG. 8 shows the top of a beverage can. The top has a pour opening 70 located beneath a sealing strip 71 having a transparent border surrounding a metallized central area. The strip 71 has a graspable tab 72 at one end which is not adhered to the can. When the can is to be opened, the tab 72 is grasped and the strip is peeled away from the top to expose the pour opening 70.

The whole of the top of the can is provided with a layer 74 of a valve metal (e.g. tantalum) magnetron sputtered or otherwise formed on the surface 75 of the material (e.g. aluminum) used to form the can. The surface of the valve metal in turn has a thin film 76 of porous anodic aluminum oxide. The thickness of the thin film is such that a color is generated at the can surface over the whole of the top. The sealing strip 71 is adhered to the thin film around the edges of the pour opening 70 and the adhesion between the thin film 76 and the Ta metal layer 74 is such that these layers are peeled apart when the sealing strip 71 is peeled from the can. Consequently, the area from which the strip 71 has been peeled loses the generated color and takes on the grey color of the Ta metal. This color change shows that the can has been opened and that the can should not be purchased if the color change is apparent prior to sale.

Figure 9:
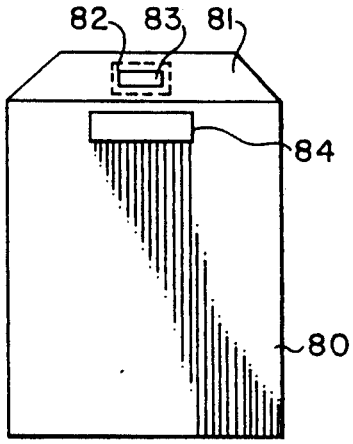

FIG. 9 shows an envelope having a body 80 and a flap 81. The envelope has a rectangular window 82 covered by a transparent layer 83 which has a layer of adhesive on the side which contacts the envelope body 80 when the flap is bent over. The adhesive on the layer 83 can form part of a strip of adhesive (not shown) on the inside of the flap used for sealing the flap to the envelope body. The envelope body 80, in the region where it is contacted with the flap 81, has a tamper-evident laminate 84 strongly adhered to the fabric of the envelope. For example, the laminate may consist of an aluminum foil substrate bearing a sputtered Ta layer and a porous aluminum oxide layer. When the flap 81 is closed, the color generated by the laminate 84 is visible through the transparent layer 83 in the rectangular window 82. The adhesive on the transparent layer causes it to adhere tightly to the laminate 84. If opening of the envelope is carried out, the transparent layer causes the laminate 84 to be peeled apart so that the generated color is lost. Re-sealing of the flap does not result in restoration of the generated color. To protect the adhesive on the transparent layer 83, the inside of the window 82 may be covered by a loosely adhering backing strip (not shown) which would be removed prior to use of the envelope. A similar backing strip could be provided over the laminate 84 provided it adhered only to the periphery of the laminate or the surrounding envelope body.

Figure 10:
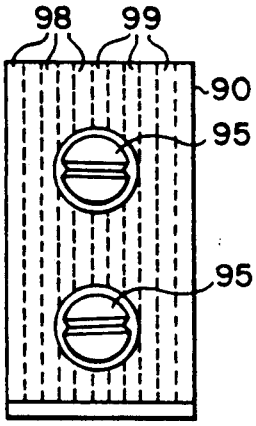
Figure 11:
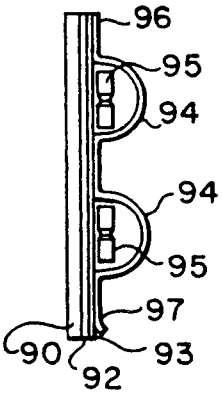

FIG. 10 is a front elevational view of a blister pack for tablets and FIG. 11 is a side elevational view of the same pack. The pack consists of a rectangle 90, made of stiff Al foil or Al foil laminated to cardboard.

The front surface of the Al rectangle 90 is provided with a sputtered layer of Ta 92 and an anodized thin porous $Al_2O_3$ film 93. This structure generates an intense color. Compartments 94 for tablets 95 are formed by adhering (e.g. adhesively or thermally) a plastic bubble sheet 96 to the thin film. One edge of the bubble sheet is not adhered in this way in order to form a graspable tab 97. The package is opened by pulling the plastic bubble sheet 96 away from the foil rectangle 90. When this is done, the parts of the bubble sheet adhering to the thin film 93 peel the oxide film away from the Ta layer so that the generated color is irreversibly lost, providing evidence that the package has been opened.

Desirably, the thin film 93 is formed on the Ta layer in such a way that areas in the form of stripes 98 adhere more weakly to the Ta layer than adjacent areas in the form of interleaved stripes 99. When the bubble.sheet 96 is peeled off, the oxide film in the stripes 98 is removed with it, whereas the oxide film in the stripes 99 remains attached to the Ta layer and instead the bubble sheet 96 is peeled away from the oxide film. The generated color is then lost only in the areas of stripes 98 so a striped pattern of colored lines separated by colorless (grey) lines is produced to warn of tampering. The overall peel strength of the bubble sheet 96 is consequently increased by the strength of adhesion between the bubble sheet and the oxide film in the stripes 99.

Prior to peeling the stripes 98 and 99 have the same appearance since the generated color is the same, and so the stripes are indicated by dotted lines in FIG. 10.

As well as being incorporated into the closure devices of containers or packages, the structures may be sold as they are, e.g. in tape or plate form, for a variety of security purposes.

The invention is illustrated further by the following Examples.

EXAMPLE 1

Tantalum metal was sputtered to a thickness of about 400Å (i.e. about 150Å in excess of the minimum of 250Å required to generate colors with a suitable transparent overlying film) onto an aluminum foil.

Aluminum metal was sputtered on top of the tantalum for several samples to thicknesses in the range of 1000–1800Å which allows the range of second order colors to be spanned.

The aluminum was anodized to consumption at 20V in a 120 g/l solution of phosphoric acid maintained at 30° C. The electrolyte was doped with hydrofluoric acid at the level of 0.1% by volume and the anodization was continued into the tantalum layer until the current decayed to a low level. This produced a tantalum oxide barrier layer approximately 340Å in thickness, corresponding to 20V of anodizing, between the tantalum and the porous aluminum oxide layer A flexible plastic strip was heat sealed to the structure.

The resulting structure generated intense second order colors ranging from yellow through red and blue to green for the different samples; the colors disappeared when the flexible strip was peeled off together with the anodic film.

EXAMPLE 2

Tantalum metal was sputtered onto an aluminum foil to a thickness of 5000Å. A Aluminum metal was then sputtered onto the tantalum coated foil to a thickness of 7000Å. Anodizing was carried out according to the procedure described in Example 1. A clear plastic adhesive strip was then laminated to the anodized foil. The color of the laminated foil was only pale green corresponding to the anodic film thickness of nearly 1 micron resulting from the relatively thick initial aluminum deposition.

On peeling the overlying tape, the color of the foil disappeared and was not regenerated on pressing the tape back onto the foil.

FIG. 12, comprising five cross-sectional transmission electron micrographs (a), (b), (c), (d), and (e), all at a magnification of 28,000X, illustrates the actual structures produced in accordance with this Example. Micrograph (a) shows the as-sputtered Al on Ta structure deposited onto Al foil. Micrograph (b) shows the as-anodized sputtered film with the porous anodic film (13) formed on the tantalum (11) after the anodization step. Micrograph (c) shows the as-anodized film with the oxide layer in the process of separating from the tantalum underlayer. Micrograph (d) shows the porous anodic film following its separation from the tantalum. The non-porous $Ta_2O_5$ barrier layer, approximately 340Å thick, is visible on one side of the film. Micrograph (e) shows the tantalum layer (11) remaining after separation of the porous film. As can be seen, the surface of the layer is suitably rough as to make it impossible to restore intimate contact with the detached film.

EXAMPLE 3

Tantalum metal was sputtered onto two inch square Corning #7059 glass slides to a thickness of 3500Å. Aluminum metal was then sputtered onto four of the Ta coated slides to thicknesses of 3000, 4000, 5500 and 6000 Å respectively. All slides were immersed in an electrolyte of 1.2 Molar phosphoric acid doped with HF acid at 0.1% by volume and anodized at 15 volts and 30° C. until the aluminum was all converted to oxide and the current decayed to a low value. The slides were then transferred to a standard nickel ANOLOK TM electrodeposition bath with only half the slides immersed. Electrodeposition was carried out using a sinusoidal waveform at 60 hz, for 25 sec at a peak voltage of 15V. The color of the as-anodized half of each slide and of the corresponding anodized and Ni electrodeposited half of each slide was noted both for normal incidence viewing and for viewing at approximately 30° from the normal direction. The color at normal viewing was significantly more intense and the color shift with angle more dramatic on the electrodeposited half of each slide compared to the anodized only half as detailed below.

| Sample Al Thickness | Anodized only half | | Anodized and Electrodeposited half | |
|---|---|---|---|---|
| | Normal viewing | 30° viewing | Normal viewing | 30° viewing |
| 3000 | pale blue-green | light pink | deep gold | blue-green |
| 4000 | champagne | light green | deep blue | red |
| 5500 | light green | light pink | deep red | dark green |
| 6000 | light pink | light green | deep green | dark blue |

Adhesive tape was pressed onto the electrodeposited half of each slide and then peeled off. On peeling, the color of the slides disappeared and was not restored on pressing back the tape.

The electrodeposited film structures produced according to the invention are illustrated in FIG. 13 comprising two crosssectional transmission electron micrographs, (a) and (b) both at a magnification of 28,000X. The sample for illustration was prepared identically to the champagne-colored, 4000Å Al sample above, except for having a tantalum underlayer of only 1500Å thickness and using a substrate of aluminum foil rather than glass. Micrograph (a) shows the as-sputtered, anodized and electrodeposited film intact on the foil substrate. Micrograph (b) shows the stripped electrodeposited anodic film with the residual tantalum oxide barrier layer.

EXAMPLE 4

Niobium metal was sputtered onto 70 micron AA3003 aluminum foil to a thickness of 1500Å. Subsequently, aluminum was sputtered onto the niobium layer to a thickness of 2000Å. Coupons of sputtered foil, approximately 28 $cm^2$, were immersed in a bath of 0.4 Molar phosphoric acid to which 0.1% (by volume) HF had been added. Anodizing was carried out at 20° C. and 15 volts until all of the aluminum was consumed and converted to oxide. The voltage was then increased to 50 volts and held for 180 seconds to anodize into the niobium. The as-anodized film color was yellow-green. Clear, colorless adhesive tape was applied to the coupons, which on peeling, delaminated the oxide thereby destroying the original yellow-green color of the laminated film. The peeled tape remained colorless and the color of the film was not regenerated on pressing back the tape.

EXAMPLE 5

Tantalum metal was sputtered onto aluminum foil to a thickness of 1500Å. Aluminum was then sputtered onto the Ta coated foil to a thickness of 5500Å. A pattern of stripes was silk-screened onto the foils using MacDermid MacuMage 19408 etch and acid resist. After ultra-violet curing the resist, the samples were anodized at 30° C. and 15 volts in 1.2 Molar phosphoric acid to which 0.05 volume percent hydrofluoric acid had been added. Anodizing was continued until all of the aluminum had been converted to oxide. The stripes of resist were then removed by dissolution in methyl ethyl ketone, leaving a pattern of lime-green stripes against a metallic background corresponding to the un-anodized regions protected by the resist. The samples were then re-anodized using identical conditions, with the exception that the electrolyte was not doped with hydrofluoric acid. The as-anodized color for the entire sample was uniformly lime-green i.e. the stripe pattern was no longer visible as the areas protected in the first anodizing step, anodized in the second step to the same thickness as the originally un-protected areas. Attaching adhesive tape to the surface and subsequently peeling resulted in loss of the green color only in the regions sensitized by the hydrofluoric acid, revealing the hidden pattern of stripes. Pressing back the tape did not restore any color and the stripe pattern remained evident on the foil.

We claim:

1. A container comprising an opening and an element closing said opening, said container incorporating a color change device which comprises:

a layer of a metal capable of generating a color by a light interference and absorption phenomenon when directly and intimately contacted with an optically thin film of light-transmitting material; and an optically thin film of light-transmitting material comprising anodic aluminum oxide directly and intimately contacting said metal capable of generating a color;

said optically thin film being detachable from said layer of metal capable of generating a color in areas of said device where a color change is desired; said color change device being visible from outside said container and being operatively associated with said element in such a way that removal or penetration of said element causes detachment of said thin film from said layer of metal capable of generating a color, at least in limited areas of said device, thus causing said color change device to undergo a visible color change.

2. A color change device which comprises:

a layer of a metal capable of generating a color by a light interference and absorption phenomenon when directly and intimately contacted with an optically thin film of light-transmitting material; and an optically thin film of light-transmitting material comprising anodic aluminum oxide directly and intimately contacting said metal capable of generating a color;

said optically thin film being detachable from said layer of metal capable of generating a color in areas of said device where a color change is desired;

wherein said optically thin film has a layer of transparent or translucent material attached thereto.

3. A device according to claim 2 wherein said layer of transparent or translucent material is flexible.

4. A device according to claim 2 wherein said optically thin film comprises a layer of porous anodic aluminum oxide.

5. A device according to claim 2, wherein said metal capable of generating a color is a valve metal.

6. A device according to claim 2 wherein said metal capable of generating a color is selected from the group consisting of Ta, Nb, Zr, Hf and Ti.

7. A device according to claim 2 wherein said metal capable of generating a color is Ta.

8. A device according to claim 2 wherein said optically thin film has a thickness such that the laminate generates a non-dichroic color.

9. A device according to claim 4 wherein said optically thin film has a thickness such that the laminate generates a dichroic color.

10. A device according to claim 2 wherein said optically thin film is detachable from said metal capable of generating a color only in limited areas of said laminate.

11. A device according to claim 2 wherein said layer of metal capable of generating a color is supported on a substrate.

12. A device according to claim 11 wherein said layer of a metal capable of generating a color is so thin that, following detachment of said film, the remaining structure cannot be anodized to the extend necessary to generate a color similar or identical to that originally generated by the device.

13. A color change device which comprises:

a layer of a metal capable of generating a color by a light interference and absorption phenomenon when directly and intimately contacted with an optically thin film of light-transmitting material; and an optically thin film of light-transmitting material comprising anodic aluminum oxide directly and intimately contacting said metal capable of generating a color;

said optically thin film being detachable from said layer of metal capable of generating a color in areas of said device where a color change is desired;

wherein said layer of metal capable of generating a color is supported on a substrate and is translucent and a surface of said substrate covered by said layer bears a visible device selected from the group consisting of a message, a pattern or a color.

14. A color change device, which comprises:

a layer of a metal capable of generating a color by a light interference and absorption phenomenon when directly and intimately contacted with an optically thin film of light-transmitting material; and an optically thin film of light-transmitting material, comprising a layer of porous anodic aluminum oxide, directly and intimately contacting said metal capable of generating a color;

said optically thin film being detachable from said layer of metal capable of generating a color in areas of said device where a color change is desired; and wherein pores formed in said thin film contain electrodeposited metal.

15. A process for producing a color change device, which comprises:

forming a color-generating laminate by providing a layer of a metal capable of generating a color by a light interference and absorption phenomenon when directly and intimately contacted with an optically thin film of light-transmitting material;

coating said layer of metal capable of generating a color with a material selected from the group consisting of aluminum and anodizable aluminum alloys to such a thickness that the resulting coating is converted to an optically thin film upon being porous anodized to consumption; and anodizing said coating to consumption in the presence of an adhesion-reducing agent to form an optically thin detachable film of light-transmitting material in direct and intimate contact with said metal capable of generating a color;

wherein a layer of transparent or translucent material is attached to said laminate.

16. A process according to claim 15 wherein said coating is subjected to said anodizing step in an electrolyte which results in the formation of a porous anodic film.

17. A process according to claim 15 wherein said metal capable of generating a color is a valve metal.

18. A process according to claim 15 wherein said metal capable of generating a color is a member selected from the group consisting of Ta, Nb, Zr, Hf and Ti.

19. A process according to claim 15 wherein said metal capable of generating a color is Ta.

20. A process according to claim 15 wherein said material selected from aluminum and aluminum alloys is coated on the metal capable of generating a color to a thickness in the range of 20–1000 nm.

21. A process according to claim 15 wherein said material selected from aluminum and aluminum alloys is coated on the metal capable of generating a color to such a thickness that, following the anodization step, the laminate generates a non-dichroic color.

22. A process according to claim 16 wherein said material selected from aluminum and aluminum alloys is coated on the metal capable of generating a color to such a thickness that, following the anodization step, the laminate generates a dichroic color.

23. A process according to claim 15 wherein said adhesion-reducing agent is coated on said material selected from aluminum and aluminum alloys prior to the anodization step.

24. A process according to claim 15 wherein the layer of metal capable of generating a color is provided by applying a layer of said metal onto a substrate.

25. A process according to claim 24 wherein said layer is made so thin that, after said anodization step and detachment of said film, the remaining structure cannot be re-anodized to form a structure having a color similar or identical to an original color of the device.

26. A process according to claim 24 wherein said layer is made so thin that it is translucent and wherein said substrate has, on a surface covered by said metal, a visible device selected from the group consisting of a message, a pattern or a color.

27. A process according to claim 15 wherein said layer of transparent or translucent material attached to said laminate is flexible.

28. A process according to claim 15 wherein said material selected from aluminum and anodizable aluminum alloys is coated on said material capable of generating a color by vacuum deposition.

29. A process according to claim 15 wherein said coating is subjected to said anodizing step in an electrolyte which results in the formation of a porous anodic film.

30. A process according to claim 15 wherein the adhesion-reducing agent is a fluoride.

31. A process according to claim 15 wherein the adhesion-reducing agent is a member selected from the group consisting of a simple and complex fluorine-containing salts and fluorine-containing acids.

32. A process for producing a color change device, which comprises:

forming a color-generating laminate by providing a layer of a metal capable of generating a color by a light interference and absorption phenomenon when directly and intimately contacted with an optically thin film of light-transmitting material;

coating said layer of metal capable of generating a color with a material selected from the group consisting of aluminum and anodizable aluminum alloys to such a thickness that the resulting coating is converted to an optically thin film upon being porous anodized to consumption; and anodizing said coating to consumption in the presence of a fluoride as an adhesion-reducing agent to form an optically thin detachable film of light-transmitting material in direct and intimate contact with said metal capable of generating a color.

33. A process according to claim 32 wherein said porous anodizing step is carried out in an electrolyte containing at least 0.005% by volume of said adhesion-reducing agent.

34. A process for producing a color change device, which comprises:

forming a color-generating laminate by providing a layer of a metal capable of generating a color by a light interference and absorption phenomenon when directly and intimately contacted with an optically thin film of light-transmitting material;

coating said layer of metal capable of generating a color with a material selected form the group consisting of aluminum and anodizable aluminum alloys to such a thickness that the resulting coating is converted to an optically thin film upon being porous anodized to consumption; and anodizing said coating to consumption in the presence of a member selected form the group consisting of simple and complex fluorine-containing salts and fluorine-containing acids as an adhesion-reducing agent to form an optically thin detachable film of light-transmitting material in direct and intimate contact with said metal capable of generating a color.

35. A process for producing a color change device, which comprises:

forming a color-generating laminate by providing a layer of a metal capable of generating a color by a light interference and absorption phenomenon when directly and intimately contacted with an optically thin film of light-transmitting material;

coating said layer of metal capable of generating a color with a material selected from the group consisting of aluminum and anodizable aluminum alloys to such a thickness that the resulting coating is converted to an optically thin film upon being porous anodized to consumption.

coating an adhesion-reducing agent on said material selected from aluminum and anodizable aluminum alloys; and anodizing said coating to consumption to form an optically thin film of light-transmitting material in direct and intimate contact with said metal capable of generating a color;

wherein the adhesion-reducing agent is coated only on limited areas of said material in order to form a latent message or pattern in said structure as a result of said film being detachable only from said limited areas.

36. A process according to claim 35 wherein said adhesion-reducing agent is coated on said limited areas by silk screening.

37. A process for producing a color change device, which comprises:

forming a color-generating laminate by providing a layer of a metal capable of generating a color by a light interference and absorption phenomenon when directly and intimately contacted with an optically thin film of light-transmitting material;

coating said layer of metal capable of generating a color with a material selected from the group consisting of aluminum and anodizable aluminum alloys to such a thickness that the resulting coating is converted to an optically thin film upon being porous anodized to consumption; and anodizing said coating to consumption in the presence of an adhesion-reducing agent to form an optically thin detachable film of light-transmitting material in direct and intimate contact with said metal capable of generating a color;

wherein said coating is subjected to said anodizing step in an electrolyte which results in the formation of a porous anodic film, and wherein a metal is electrodeposited into pores in said porous film.

* * * * *